US011197521B2

(12) United States Patent
Kayahara et al.

(10) Patent No.: US 11,197,521 B2
(45) Date of Patent: Dec. 14, 2021

(54) SLIDE FASTENER

(71) Applicant: YKK Corporation, Tokyo (JP)

(72) Inventors: Masanori Kayahara, Kurobe (JP); Mineto Terada, Kurobe (JP); Ryo Mikuma, Kurobe (JP); Kazuya Taniguchi, Kurobe (JP); Yuki Sakagami, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/981,525

(22) PCT Filed: Mar. 19, 2018

(86) PCT No.: PCT/JP2018/010685
§ 371 (c)(1),
(2) Date: Sep. 16, 2020

(87) PCT Pub. No.: WO2019/180758
PCT Pub. Date: Sep. 26, 2019

(65) Prior Publication Data

US 2021/0007447 A1 Jan. 14, 2021

(51) Int. Cl.
*A44B 19/24* (2006.01)
*A44B 19/36* (2006.01)
*A44B 19/34* (2006.01)

(52) U.S. Cl.
CPC ..... *A44B 19/36* (2013.01); *A44B 19/34* (2013.01)

(58) Field of Classification Search
CPC ..... A44B 19/36; A44B 19/34
See application file for complete search history.

(56) References Cited

U.S. PATENT DOCUMENTS 2,190,608 A * 2/1940 Poux ..... A44B 19/36 24/388
2,496,878 A * 2/1950 Krupp ..... A44B 19/32 24/389
3,138,842 A * 6/1964 Frank ..... G09F 3/0305 24/615

(Continued)

FOREIGN PATENT DOCUMENTS

JP 5844391 B2 1/2016
WO 2015/063927 A1 5/2015

OTHER PUBLICATIONS

International Search Report, PCT Patent Application No. PCT/JP2018/010685, dated May 1, 2018.

(Continued)

*Primary Examiner* — Jason W San
(74) *Attorney, Agent, or Firm* — Kilpatrick Townsend & Stockton LLP

(57) ABSTRACT

A slide fastener includes a resin sheet that joins tapes on one surface among both surfaces of the tapes in a thickness direction, and that extends from a stop on a side opposite to element rows and is integral with the stop. The stop includes recesses on a boundary portion with the sheet of left and right side portions that respectively correspond to the tapes, and includes a recess region in a surface of the stop that is a region whose range in a left-right direction is defined by leftmost and rightmost ones of the recesses. A surface of the sheet includes a flat portion that is a region extending from the recess region toward the side opposite to the element rows.

7 Claims, 6 Drawing Sheets

(56) References Cited

U.S. PATENT DOCUMENTS

| | | | | |
|---|---|---|---|---|
| 4,524,493 | A * | 6/1985 | Inamura | A44B 19/36 24/389 |
| 4,825,514 | A * | 5/1989 | Akeno | A44B 19/36 24/389 |
| 5,065,602 | A * | 11/1991 | Williams | A44B 19/301 70/68 |
| 5,081,855 | A * | 1/1992 | Terada | A44B 19/301 70/68 |
| 5,253,395 | A * | 10/1993 | Yano | A44B 19/265 24/387 |
| 9,138,033 | B2 * | 9/2015 | Kojima | A44B 19/26 |
| 9,314,069 | B2 * | 4/2016 | Takazawa | A44B 19/386 |
| 2002/0070566 | A1 * | 6/2002 | Hudson | A44B 19/301 292/315 |
| 2007/0067969 | A1 * | 3/2007 | Kusayama | A44B 19/32 24/436 |
| 2011/0126383 | A1 * | 6/2011 | Takazawa | A44B 19/26 24/389 |
| 2011/0162140 | A1 * | 7/2011 | Paris | A47G 9/0261 5/499 |
| 2012/0084918 | A1 * | 4/2012 | Rattner | A47C 31/105 5/500 |
| 2012/0260426 | A1 * | 10/2012 | Dobin | A47C 31/105 5/499 |
| 2012/0311785 | A1 * | 12/2012 | Goldberg | A47G 9/0253 5/498 |
| 2014/0137375 | A1 * | 5/2014 | Tanaka | A44B 19/32 24/389 |
| 2015/0000087 | A1 * | 1/2015 | Tanaka | A44B 19/36 24/389 |

OTHER PUBLICATIONS

Written Opinion, PCT Patent Application No. PCT/JP2018/010685, dated May 1, 2018.

* cited by examiner

SLIDE FASTENER

TECHNICAL FIELD

The present invention is related to a slide fastener.

BACKGROUND ART

As an example for slide fastener, there is a slide fastener including a pair of fastener stringers, a slider that moves along facing side edges of the pair of fastener stringers, and a resin stop that stops movement of the slider and joins the pair of fastener stringers (see Patent Literature 1).

The fastener stringer includes a pair of tapes extending in a front-rear direction and arranged adjacent to each other in the left-right direction, and a pair of element rows fixed along facing side edges of the pair of tapes.

The stop includes a main body portion that stops movement of the slider, and an extension portion extending from the main body portion toward a side opposite to the pair of element rows. In the description of Patent Literature 1, the main body portion and the extension portion are included as one concept by the stop, but in the present invention to be described in detail later, the main body portion and the extension portion are different concepts, and different names are used. The main body portion and the extension portion are formed on both surfaces in a thickness direction of the tapes, and have recesses on both surfaces thereof.

The recesses are evenly spaced across both entire surfaces in the thickness direction of the tapes at intervals in the front-rear direction and the left-right direction. Further, the recesses are marks formed when the stop is formed by injection molding. More specifically, when the stop is formed by injection molding, the tapes or a part of the element rows are pressed by pins in a cavity space of a mold for molding. Then, marks formed due to pressing by the pins become the recesses.

CITATION LIST

Patent Literature

Patent Literature 1: Japanese Patent No. 5844391

SUMMARY OF INVENTION

Technical Problem

The recesses are formed on both surfaces of the tapes in the extension portion so that when molten resin is powerfully injected from both surfaces of the tapes at the time of injection molding, the tapes are prevented from flapping due to the power. For the same reason, the recesses are evenly spaced across both entire surfaces in the thickness direction of the tapes at intervals in the front-rear direction and the left-right direction. Incidentally, when the tapes flap at the time of injection molding, an appearance of the sheet, and thus an appearance of the slide fastener, is deteriorated.

Further, since the recesses are formed not only on the main body portion of the stop but also on the extension portion, a formation range of the recesses extends over a wide range, which impairs the appearance of the slide fastener.

The slide fastener may be adhered to an object. In this case, adhesive layers are present between the tapes and the object and between the stop and the object. As described above, in the slide fastener described above, the recesses are formed not only on the main body portion of the stop but also on the extension portion. In this case, an adhesive accumulates in the recesses, a thick portion and a thin portion of the adhesive layer are formed, and an adhesion state is not preferable.

The present invention has been made in view of the above circumstances, and an object thereof is to provide a slide fastener that can reduce a formation range of recesses as much as possible.

Solution to Problem

A slide fastener of the present invention includes: a pair of fastener stringers including a pair of tapes which extend in a front-rear direction and are arranged adjacent to each other in a left-right direction and a pair of element rows which are fixed along facing side edges of the pair of tapes; a slider configured to move along the pair of element rows; a resin stop configured to stop a movement of the slider and joining the pair of tapes at a front or rear side of the pair of element rows; and a resin sheet that joins the pair of the tapes on one surface among both surfaces of the pair of the tapes in a thickness direction of the pair of the tapes, and that extends from the stop on a side opposite to the pair of element rows and is integral with the stop. The pair of tapes include a first exposed surface that is a visibly exposed portion corresponding to the sheet in a surface opposite to the sheet among both the surfaces of the pair of tapes in the thickness direction. The stop includes recesses on a boundary portion with the sheet of a left side portion and a right side portion that respectively correspond to the pair of the tapes, and includes a recess region in a surface of the stop that is a region whose range in the left-right direction is defined by leftmost and rightmost ones of the recesses. A surface of the sheet includes a flat portion that is a region extending from the recess region toward the side opposite to the pair of element rows in the front-rear direction.

The pair of tapes may or may not include a visibly exposed portion corresponding to the recess region in a surface opposite to the one surface among both the surfaces of the pair of tapes in the thickness direction. However, in order to reduce a formation range of the recesses as much as possible, the following is preferable.

That is, the pair of tapes include a second exposed surface that is a portion corresponding to the recess region in the surface opposite to the sheet among both the surfaces in the thickness direction of the pair of tapes.

As viewed from the thickness direction of the tapes, the sheet may have any shape with respect to the stop. Specific examples thereof include the following.

That is, the sheet includes projecting portions respectively projecting toward left and right sides with respect to the stop and a sheet main body portion positioned between the projecting portions on the left and right sides. In addition, a surface of the sheet main body portion is a flat portion.

Although an entire area of the surface of the sheet may or may not be a flat portion, when the slide fastener is adhered to an object, in order to make the thickness of the adhesive layer interposed between the sheet and the object as uniform as possible so as to approach an ideal adhesion state, the following is preferable.

That is, the entire area of the surface of the sheet is a flat portion.

The stop may include the recess at any part in the left-right direction including a left side portion and a right side portion in a boundary portion with the sheet of the stop.

The stop and the sheet are integral (integrally molded), and are injection molded with respect to the tapes. The recesses are marks formed when the tapes are pressed by pins at the time of injection molding. In addition, if the pair of tapes is prevented from flapping as much as possible at the time of injection molding, the appearance of the slide fastener can be improved. For this purpose, as a portion at which the pair of tapes are pressed by the pins, facing side edges are more preferable than sides opposite to the facing side edges.

Further, parts of the pair of tapes that are away from the stop in a direction opposite to the pair of element rows among the front-rear direction may or may not be in contact with each other on the left and right sides.

In order to improve the sealing property and the appearance of the slide fastener, the following is preferable.

That is, the pair of tapes are in contact with each other in the left-right direction at portions of the facing side edges corresponding to the first exposed surface and the second exposed surface. Further, the stop includes the recess on each of a right part of the left side portion and a left part of the right side portion.

The stop may include any number of recesses on the right part of the left side portion and the left part of the right side portion, and may or may not include the recess on the left part of the left side portion and the right part of the right side portion. In order to improve the appearance of the slide fastener, the following is preferable.

That is, the stop includes a plurality of recesses at an interval in the left-right direction on each of the left side portion and the right side portion.

The recess is only required to be present at the boundary portion with the sheet of the stop. Further, the following specifies a specific position of the recess in relation to a portion related to the slider.

That is, the slider includes a pair of blade plates facing each other in a state of sandwiching the pair of element rows in a thickness direction of the slider, and a connection column that connects the pair of blade plates and that is configured to move between the pair of element rows, The stop includes a housing configured to house the connection column, and a stopper that protrudes from a surface opposite to one surface in the thickness direction with respect to the housing and that is configured to abut with one of the blade plates. The recess is arranged on a side opposite to the pair of element rows with respect to the stopper.

Advantageous Effects of Invention

Although the slide fastener of the present invention includes the recess one the stop, since the surface of the sheet includes the flat portion that is a region extending from the recess region toward the side opposite to the pair of element rows, the formation range of the recess is smaller than that of a case where a recess is in a portion corresponding to the flat portion of the surface of the sheet, for example.

Since the slide fastener includes the second exposed surface that is a portion corresponding to the recess region in the surface opposite to the sheet among both the surfaces in the thickness direction of the pair of tapes, the formation range of the recess is smaller than that of a case where a recess is in a portion corresponding to the recess region, for example.

In the slide fastener, since the entire area of the surface of the sheet is a flat portion, the formation range of the recess is smaller than that of a case where a recess is at a position on the surface of the sheet, for example.

In the slide fastener, since the stop includes the recess on each of the right part of the left side portion and the left part of the right side portion, as compared to a case where the stop includes the recess on each of the left part of the left side portion and the right part of the right side portion, for example, the pair of tapes can be prevented from flapping as much as possible at the time of injection molding, and the appearance of the slide fastener can be improved. Further, in the slide fastener, the pair of tapes are in contact with each other on the left and right sides at portions of the facing side edges corresponding to the first exposed surface and the second exposed surface, which improves the sealing property.

In the slide fastener, since the stop includes a plurality of recesses at an interval in the left-right direction on each of the left side portion and the right side portion, as compared to a case where the stop includes one recess on each of the left side portion and the right side portion, for example, the pair of tapes can be prevented from flapping as much as possible at the time of injection molding, and the appearance of the slide fastener can be improved.

DESCRIPTION OF EMBODIMENTS

Figure 1:
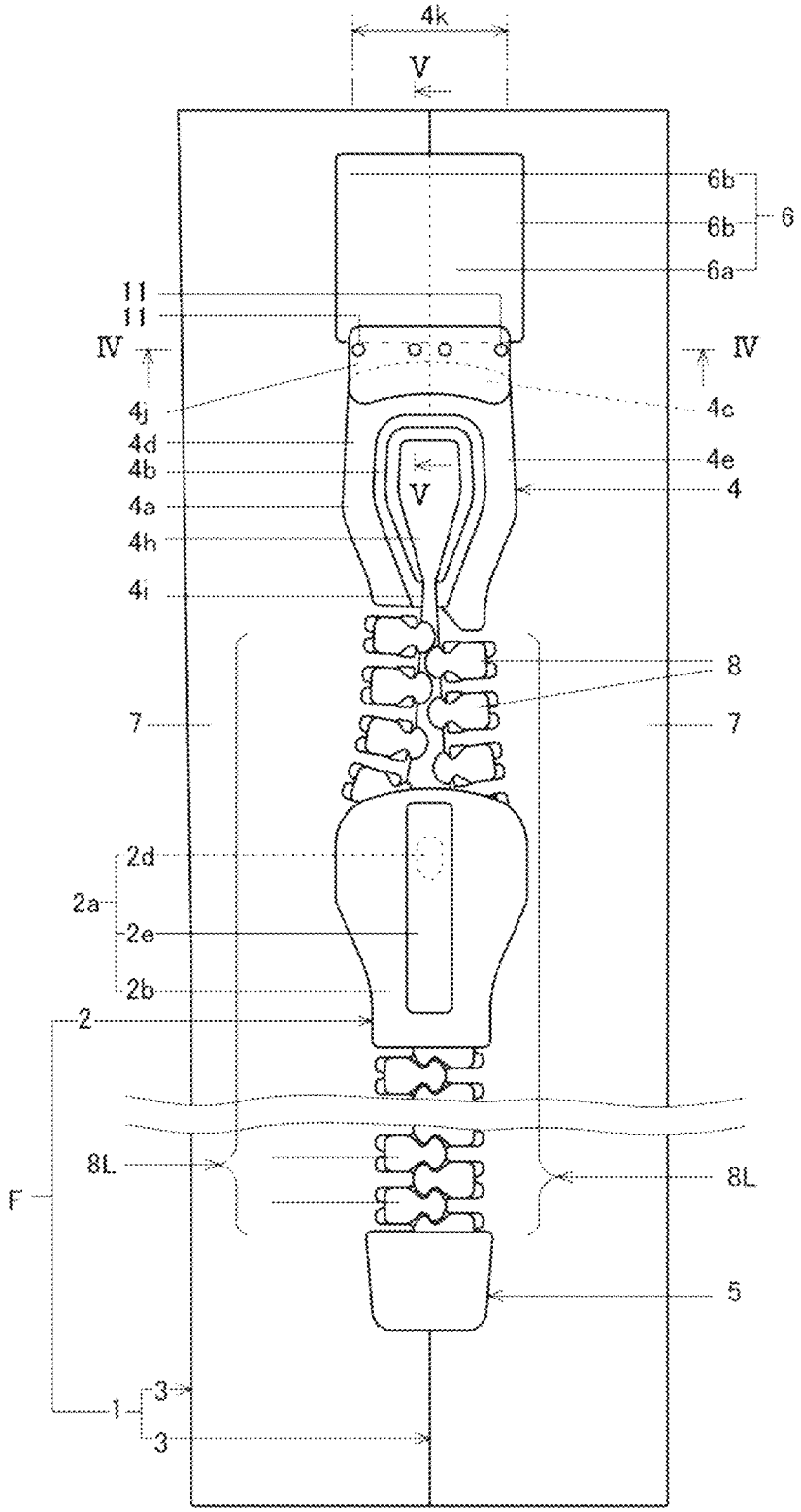
FIG. 1 is a plan view showing a slide fastener according to a first embodiment of the present invention.
Figure 2:
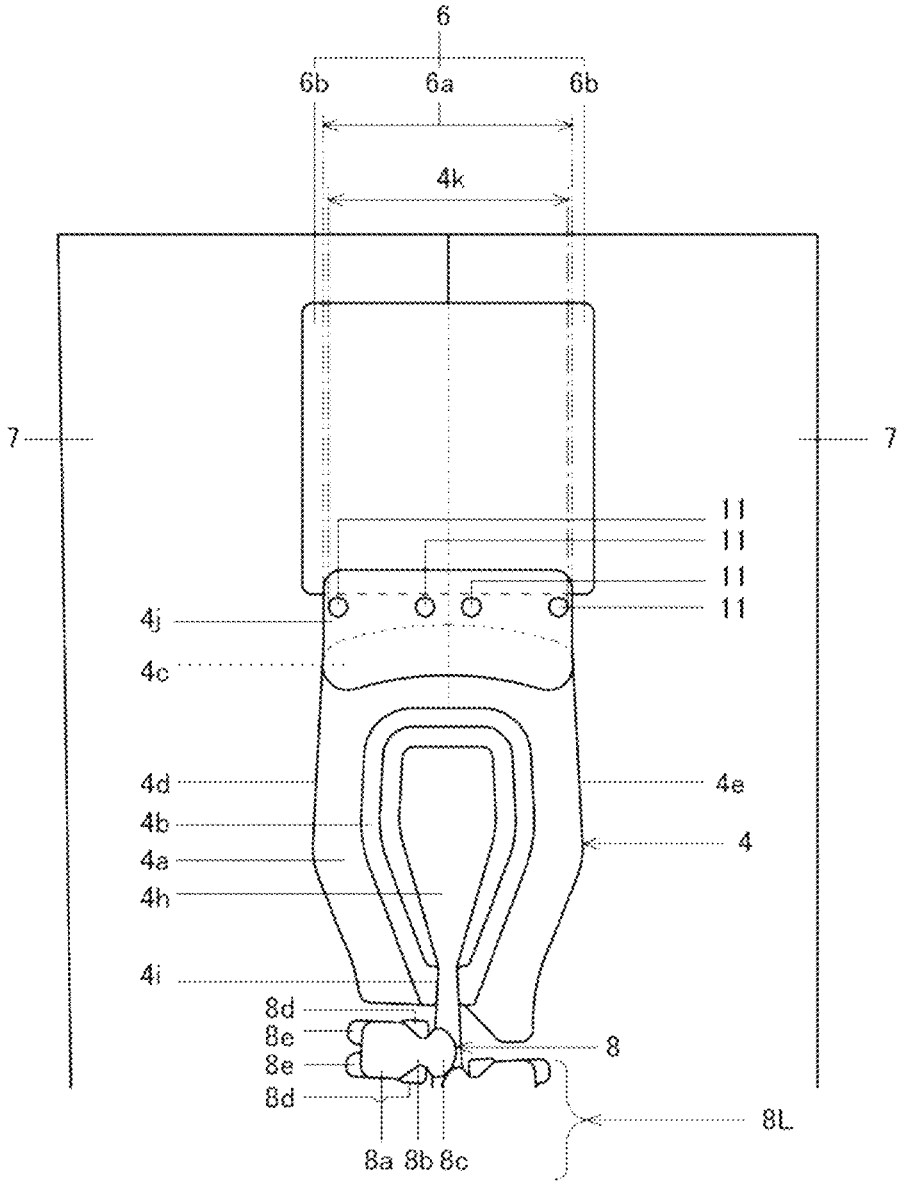
FIG. 2 is an enlarged plan view of a main part of FIG. 1.
Figure 3:
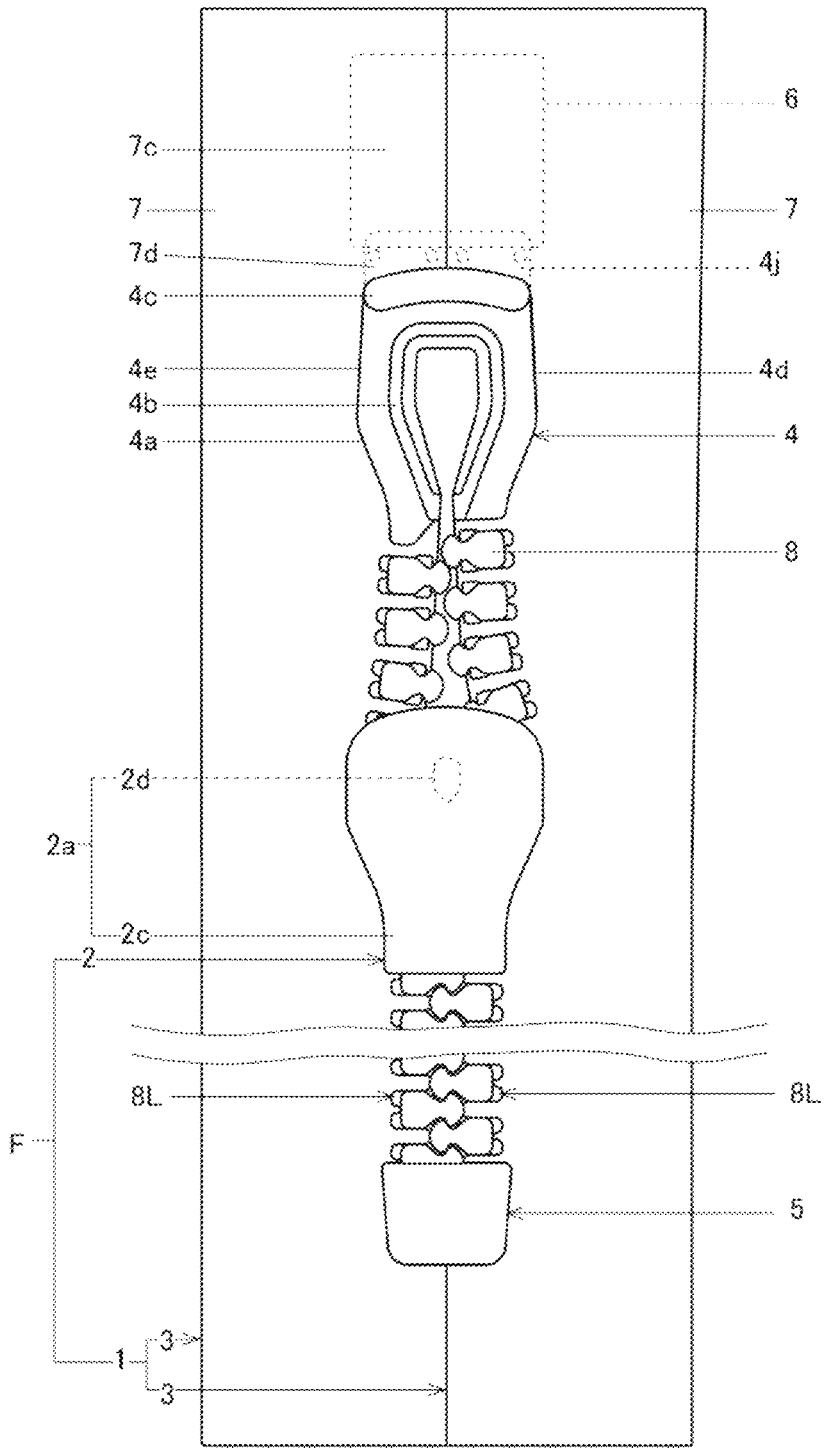
FIG. 3 is a bottom view showing the slide fastener according to the first embodiment.

As shown in FIGS. 1 to 3, a slide fastener F of a first embodiment of the present invention includes an openable and closable fastener chain 1 and a slider 2 that is movable to open and close the fastener chain 1.

The fastener chain 1 includes a pair of fastener stringers 3, 3 arranged adjacent to each other, a first stop 4 and a second stop 5 that stop movement of the slider 2 on both sides in a movement direction with respect to a movement range of the slider 2, and a sheet 6 that joins the pair of fastener stringers 3, 3 on one surface in a thickness direction of the sheet 6.

By moving the slider 2 in one direction, the pair of fastener stringers 3, 3 can be opened, and abuts with the second stop 5 when reaching one of limit positions of the movement range. Further, by moving the slider 2 in the other direction, the pair of fastener stringers 3, 3 can be closed, and abuts with the first stop 5 when reaching the other of the limit positions of the movement range.

Hereinafter, to explain the slide fastener F, directions are defined as follows.

A front-rear direction is a direction in which the slider 2 is moved, and is also a longitudinal direction of the pair of fastener stringers 3, 3. The front-rear direction is an upper-lower direction in FIG. 1. A front direction is a direction in which the slider 2 is moved in order to close the fastener chain 1, and is an upper direction in FIG. 1. A rear direction is a direction in which the slider 2 is moved in order to open the fastener chain 1, and is a lower direction in FIG. 1.

A left-right direction is a direction in which the pair of fastener stringers 3, 3 are arranged adjacent to each other. A left direction is a left direction in FIG. 1. A right direction is a right direction in FIG. 1.

An upper-lower direction is a direction orthogonal to the front-rear direction and the left-right direction, and is a thickness direction of the fastener stringer 3, which coincides with a thickness direction of tapes and a thickness direction of a pair of element rows to be described later. The upper-lower direction is a direction orthogonal to the page of FIG. 1. An upper direction is a direction out of the page of FIG. 1. A lower direction is a direction into the page of FIG. 1.

The pair of fastener stringers 3, 3 respectively includes a pair of tapes 7, 7 extending in a front-rear direction and arranged adjacent to each other in a left-right direction and a pair of element rows 8L, 8L fixed along facing side edges of the pair of tapes 7, 7.

Figure 4:
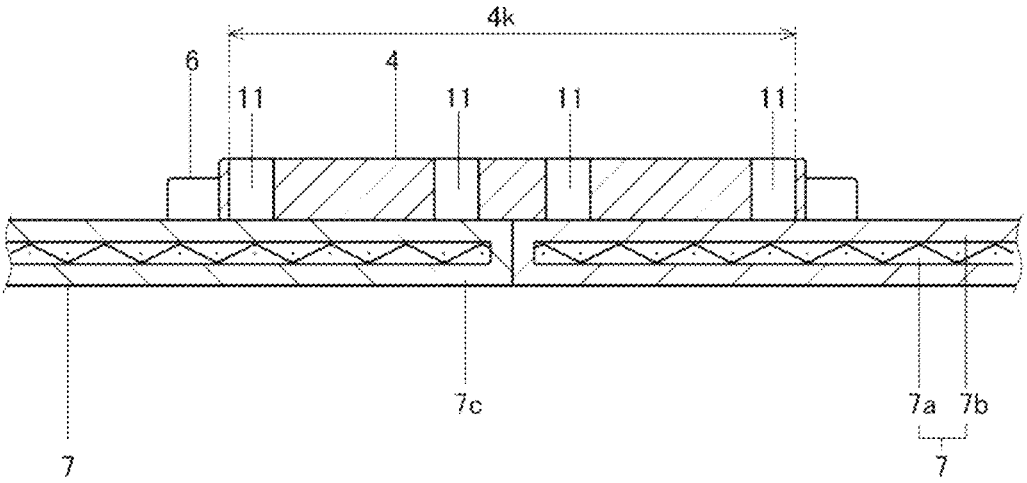
FIG. 4 is a cross-sectional view taken along line IV-IV in FIG. 1.
Figure 5:
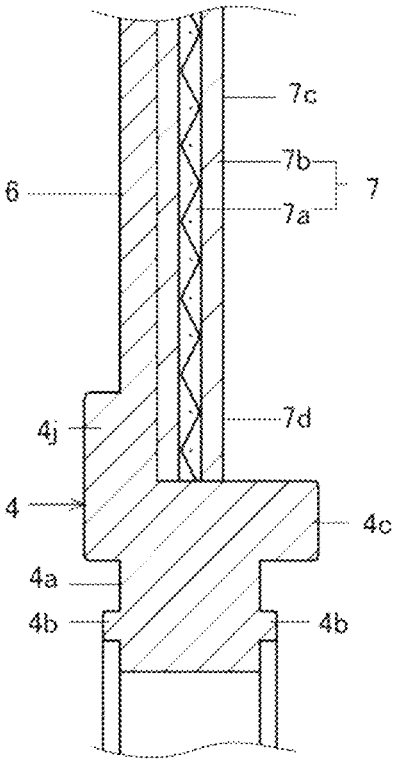
FIG. 5 is a cross-sectional view taken along line V-V of FIG. 1.
Figure 6:
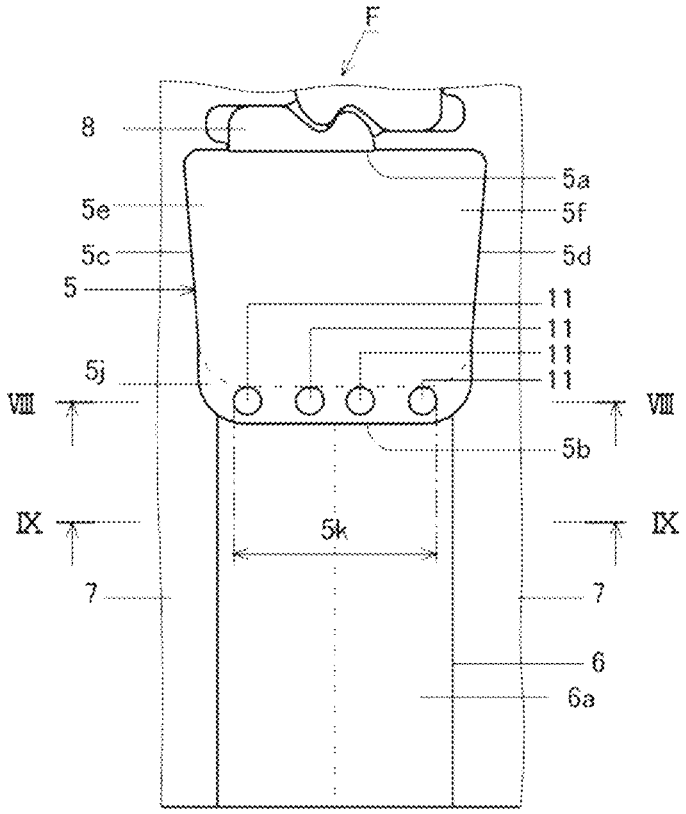
FIG. 6 is a plan view showing a part of a slide fastener according to a second embodiment of the present invention.
Figure 7:
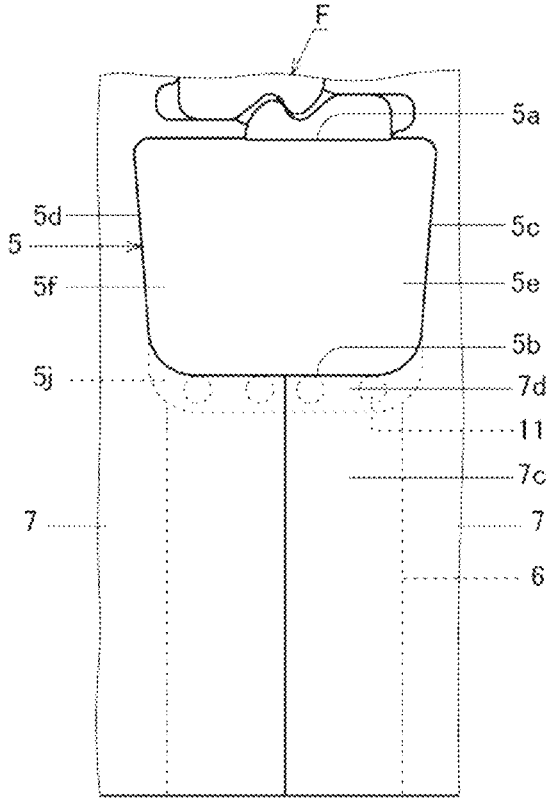
FIG. 7 is a bottom view showing a part of a slide fastener according to a second embodiment of the present invention.
Figure 8:
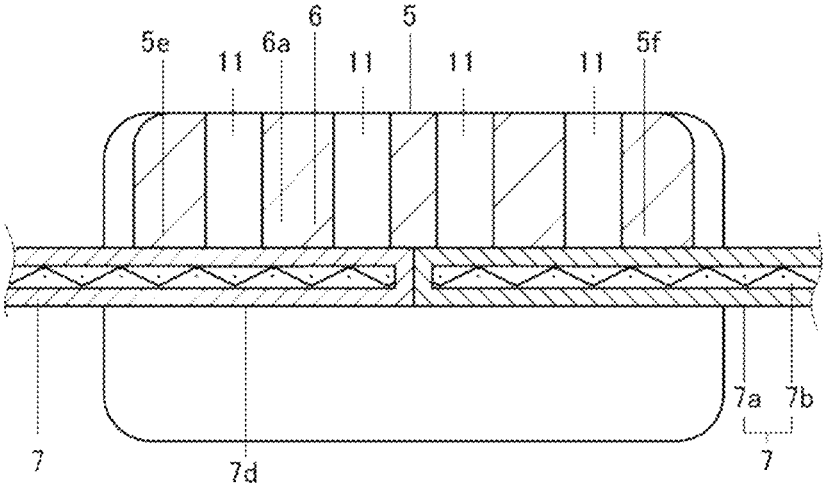
FIG. 8 is a cross-sectional view taken along line VIII-VIII in FIG. 6.
Figure 9:
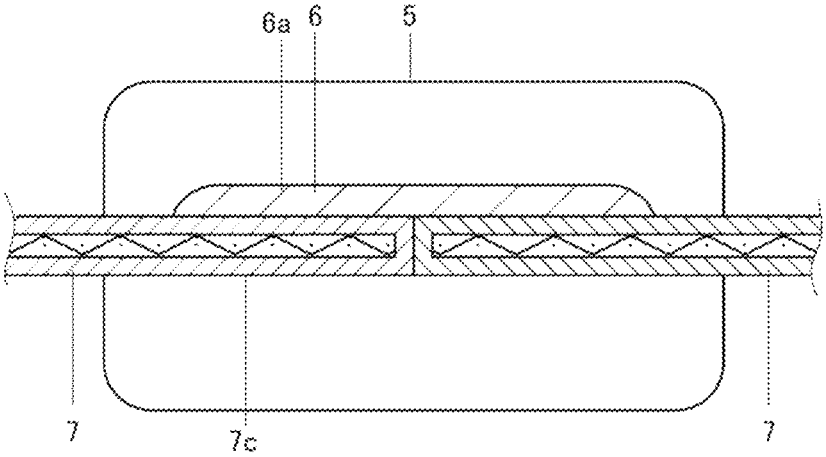
FIG. 9 is a cross-sectional view taken along line IX-IX in FIG. 6.

As shown in FIGS. 4 and 5, each tape 7 has a strip shape that is long in the front-rear direction, and the thickness direction thereof is the upper-lower direction. The tape 7 includes a tape main body 7*a* made of a woven fabric or a knitted fabric, and a plate-shaped coating layer 7*b* covering at least a surface on the sheet 6 side with respect to the tape main body 7*a* among both surfaces in the thickness direction of the tape body 7*a*. More specifically, in the present embodiment, the tape 7 is formed by covering both upper and lower surfaces and right and left side surfaces of the tape main body 7*a* with the coating layer 7*b*. Therefore, the tape 7 has a property of stopping passage of water in the thickness direction thereof, that is, a water-stopping property.

The coating layer 7*b* is a layer made of a resin having elasticity, for example, a vinyl chloride or a thermoplastic elastomer (polyethylene or synthetic rubber), and is formed by performing injection molding with respect to the tape main body 7*a*.

In the tape 7, the surface on the sheet 6 side among both the surfaces in the thickness direction thereof (an upper surface) is a flat surface, and the tape 7 does not have a through hole penetrating in the upper-lower direction in a portion corresponding to the sheet 6.

The pair of tapes 7, 7 include the sheet 6 only on one surface of both the surfaces in the thickness direction thereof. The pair of tapes 7, 7 include a first exposed surface 7*c* that is a visibly exposed portion of a surface (a lower surface) opposite to the sheet 6 (a portion corresponding to the sheet 6) among both the surfaces in the thickness direction of the tapes 7, 7 in the surface opposite to the sheet 6. The pair of tapes 7, 7 include a second exposed surface 7*d* that is a visibly exposed portion between the first exposed surface 7*c* and the first stop 4.

In addition, facing side edges of the pair of tapes 7, 7 are in contact with each other in a portion opposite to the pair of element rows 8L, 8L with respect to the first stop 4 and in a portion opposite to the pair of element rows 8L, 8L with respect to the second stop 5. Therefore, the pair of tapes 7, 7 are in contact with each other on the left and right sides at portions of the facing side edges corresponding to the first exposed surface 7*c* and the second exposed surface 7*d*.

Each element row 8L is formed by a number of elements 8 fixed at an interval in the front-rear direction along the facing side edge of the tape 7. More specifically, the elements 8 are made of a resin harder than the tape 7, and are formed by performing injection molding (insert molding) with respect to the tape 7. In a state in which the pair of fastener stringers 3, 3 are closed, the elements 8 of the pair of element rows 8L, 8L mesh with one another, and in a state in which the pair of fastener stringers 3, 3 are opened, the elements 8 of the pair of element rows 8L, 8L are separated on the right and left sides.

As shown in FIG. 2, each element 8 includes a body 8*a* that is fixed to the tape 7 and extends in the left-right direction, a neck 8*b* protruding from an intermediate portion in the front-rear direction of the body 8*a* toward the facing tape 7, a head 8*c* protruding from the neck 8*b* toward the facing tape 7 and projecting in the front-rear direction, a pair of shoulders 8*d*, 8*d* protruding from both the front and rear sides of the neck 8*b*, and fins 8*e* protruding from the body 8*a* toward a side opposite to the facing tape 7. In the illustrated example, two fins 8*e* are provided at an interval in the front-rear direction. The pair of fins 8*e*, 8*e* and the pair of shoulders 8*d*, 8*d* are formed thinner than the body 8*a* in a stepped manner. The pair of fins 8*e*, 8*e*, the body 8*a*, the pair of shoulders 8*d*, 8*d* and the neck 8*b* have intermediate portions in the thickness direction thereof embedded with the facing side edge of the tape 7, so that the element 8 is fixed in a manner sandwiching the tape 7 from the upper and lower sides.

A protrusion length of the fins 8*e* in the thickness direction of the tape 7 is shorter than that of the shoulders 8*d*. Upper and lower surfaces of the fins 8*e* and a surface on the fin 8*e* side among left and right side surfaces of the body 8*a* are surfaces that are in contact with upper-lower flanges of the slider 2 to be described later when the flanges move.

The head 8*c* has a locking groove (not shown) on a tip end surface of the facing tape 7. The locking groove opens toward the facing tape 7 side and toward the front-rear direction. In a state in which the elements 8 are meshed with one another, a pair of shoulders 8*d*, 8*d* on the facing tape 7 side are fitted inside the locking groove. The elements 8 are meshed with and separated from one another by the slider 2.

As shown in FIGS. 1 and 3, the slider 2 moves along the pair of element rows 8L, 8L. The slider 2 includes a slider body 2*a* that is engaged with the pair of element rows 8L, 8L and is movable in the front-rear direction, and a pull tab (not shown) coupled to the slider body 2*a*.

The slider body 2*a* includes blade plates 2*b*, 2*c* facing each other at an interval in the upper-lower direction, a connection column 2*d* connecting the upper and lower blade plates 2*b*, 2*c*, and flanges (not shown) protruding in a direction that narrows a facing interval of the upper and lower blade plates 2*b*, 2*c* from left and right ends of at least one of the upper and lower blade plates 2*b*, 2*c*.

The connection column 2*d* extends in the upper-lower direction, and connects the upper and lower blade plates 2*b*, 2*c* at an intermediate portion in the left-right direction at the front portion of each other. The connecting column 2*d* is sandwiched between the pair of element rows 8L, 8L.

In addition to the upper and lower blade plates 2*b*, 2*c*, the connecting column 2*d*, and the flanges, the slider body 2*a* includes a pull tab attachment portion 2*e* protruding on a surface side of one of the pair of blade plates 2*b*, 2*c* (an upper surface side of the upper blade plate 2*b* in the illustrated example).

A through hole (not shown) for attaching the pull tab is formed in the pull tab attachment portion 2*e*.

As shown in FIGS. 1 to 3, the first stop 4 is fixed in a state joining end portions in the longitudinal direction of the pair of tapes 7, 7 (that is, front end portions), and is more specifically fixed to the pair of tapes 7, 7 on the front side of the element rows 8L with a gap therebetween. The first stop 4 is a resin having rubber elasticity, for example, a thermoplastic elastomer (polyurethane or the like), and is elastically deformable due to the rubber elasticity. The first stop 4 includes a housing 4*a* for accommodating the connection column 2*d* of the slider 2 in and out of the housing 4*a*, a pair of raised walls 4*b*, 4*b* raised from both surfaces in the thickness direction (upper and lower surfaces) of the housing 4*a* so as to be close contact with the upper and lower blade plates 2*b*, 2*c* of the slider 2, and a stopper 4*c* protruding from a front portion of one surface in the thickness direction (an upper surface) of the housing 4*a* to a height facing a front surface of one of the upper and lower blade plates 2*b*, 2*c* (a front surface of the upper blade plate 2*b* in the figure). As viewed from the thickness direction of the tapes 7, the first stop 4 includes a left side portion 4*d* corresponding to the left tape 7 and a right side portion 4*e* corresponding to the right tape 7.

The housing 4*a* has the facing side edges of the pair of tapes 7, 7 embedded therein. More specifically, with respect to the facing side edges of the pair of tapes 7, 7, the housing 4*a* covers the upper and lower surfaces of the pair of tapes 7, 7 and covers the facing surfaces of the pair of tapes 7, 7. The housing 4*a* has an openable and closable annular shape surrounding the connecting column 2*d* from an outer peripheral side thereof, and has, on an inner side thereof, a column housing hole 4*h* formed in a manner penetrating in the upper-lower direction so as to house the connection column 2*d*, and has an openable and closable inlet 4*i* so as to allow the connection column 2*d* to enter and exit the column housing hole 4*h*. The housing 4*a* is openable and closable due to the rubber elasticity of the first stopper 4, forms a passage communicating with the column housing hole 4*h* in a state in which the inlet portion 4*i* is opened, and is in close contact in the left-right direction in a state in which the inlet portion 4*i* is closed. The housing 4*a* includes a gate mark (not shown) on a surface facing the column housing hole 4*h*. The gate mark is formed when a gate is cut after the first stop 4 and the sheet 6 are integrally molded by injection molding (insert molding). The gate marks are formed on both surfaces in the thickness direction of the sheet 6 at an intermediate portion in the thickness direction of the housing 4*a*.

The pair of raised walls 4*b*, 4*b* are formed to extend along an entire periphery of the housing 4*a* and to protrude toward a center in an inner-outer direction with respect to an annular shapes on both the upper and lower surfaces of the housing 4*a*. Surfaces of the pair of raised walls 4*b*, 4*b* are in close contact with the upper and lower blade plates 2*b*, 2*c*.

The stopper 4*c* has a length (thickness) protruding in the thickness direction from the housing 4*a* longer than that of the raised walls 4*b*, and faces the front surface of the lower blade plate 2*c*, which is one of the pair of blade plates 2*b*, 2*c*. The stopper 4*c* is formed at a front end portion of the accommodating body 4*a* so as to be in a position that abuts with the front surface of the one (lower) blade plate 2*c* in a state in which the connection column 2*d* is housed in the column housing hole 4*h*. A width in the front-rear direction of the stopper 4*c* is wider than a width of the raised walls 4*b* (a width in the inner-outer direction with respect to the annular shape). In the present embodiment, on a side opposite to the stopper 4*c* with reference to the pair of tapes 7, 7, the housing 4*a* (the first stop 4) extends to be closer to the sheet 6 than the stopper 4*c*. Therefore, in the present embodiment, a position of an end opposite to the pair of element rows 8L, 8L among ends in the front-rear direction of the housing 4*a* is different between a portion on the sheet 6 side of the housing 4*a* (the first stop 4) and the portion on the stopper 4*c* side of the housing 4*a*. That is, the portion on the sheet 6 side of the housing 4*a* (the first stop 4) extends closer to the sheet 6 than the portion on the side opposite to the sheet 6. In such a case, the portion extending to the sheet 6 is a boundary portion 4*j* with the sheet 6 of the first stop 4. The pair of tapes 7 include a second exposed surface 7*d* that is a portion of a surface opposite to the boundary portion 4*j* (a portion corresponding to the boundary portion 4*j*) in the surface opposite to the sheet among both the surfaces in the thickness direction thereof.

The recesses 11 are formed on a surface (surface in the thickness direction (upper surface)) of the boundary portion 4*j*. Each recess 11 are holes corresponding to the pins at the time of injection molding (marks formed when the tapes 7 are pressed by the pins), and columnar space portions are formed therein. A depth of each recess 11 is a depth that can be recognized as recessed by naked eye. A bottom in the thickness direction of the recess 11 coincides with the surface of the tape 7 (surface in the thickness direction (upper surface)). That is, the bottom of the recess 11 coincides with the coating layer 7*b* of the tape 7, and does not reach the tape main body 7*a*.

The recesses 11 are formed in the left side portion 4*d* and the right side portion 4*e* of the first stop 4. More specifically, a plurality of the recesses 11 are formed at an interval in the left-right direction in the left side portion 4*d* of the first stop 4, and a plurality of recesses 11 are formed at an interval in the left-right direction in the right side portion 4*e* of the first stop 4. More specifically, the recesses 11 are respectively formed in a right part and a left part of the left side portion 4*d* of the first stop 4, and the recesses 11 are also respectively formed in a right part and a left part of the right side portion 4*e* of the first stop 4. Here, the right part and the left part are based on a position obtained by dividing a total length in the left-right direction into two equal parts. On the surface of the boundary portion 4*j*, the recesses 11 are formed left-right symmetrically with respect to a gap between the pair of tapes 7, 7. A leftmost recess 11 is formed on the right side of a left end of the boundary portion 4*j*, and a rightmost recess 11 is formed on the left side of a right end of the boundary portion 4*j*. A region whose range in the left-right direction is defined by the leftmost recess 11 and the rightmost recess 11 is defined as a recess region 4*k* of the surface of the first stop 4. The sheet 6 joins the pair of tapes 7, 7 in a state adjacent to the recess region 4*k*. Since a part of the boundary portion 4*j* is the recess region 4*k* and the pair of sheets 7, 7 include the second exposed surface 7*d* that is a portion of the surface opposite to the boundary portion 4*j* (a portion corresponding to the boundary portion 4*j*) among both the surfaces in the thickness direction thereof, a portion of the surface opposite to the recess region 4*k* (a portion corresponding to the recess region 4*k*) is a part of the second exposed surface 7*d*.

The sheet 6 has water-stopping property, and is a water-stopping material made of a resin having elasticity, for example, a vinyl chloride or a thermoplastic elastomer (polyethylene or synthetic rubber).

The entire area of the surface of the sheet 6 is a flat portion, and does not have the recesses 11 as the first stop 4. The flat portion refers to a state recognized as flat by naked eye.

The sheet 6 includes the projecting portions 6*b* respectively projecting toward left and right sides with respect to the first stop 4 and the sheet main body portion 6*a* positioned between the projecting portions 6*b* on the left and right sides.

The sheet main body portion 6*a* is adjacent to the boundary portion 4*j*, and thus is wider than the recess region 4*k* in the left-right direction. Since the entire surface of the sheet 6 is a flat portion as described above, the entire surface of the sheet main body portion 6*a* is also a flat portion, and the region extending from the recess region 4*k* toward the side opposite to the pair of element rows 8L, 8L is also a flat portion.

The sheet 6 is thicker than the portions other than a boundary portion with the first stop 4. The portions of the sheet 6 other than the boundary portion with the first stop 4 are thinner than the portion on the sheet 6 side of the housing 4*a* of the first stop 4. The boundary portion with the first stop 4 of the sheet 6 and the boundary portion 4*j* with the sheet 6 of the first stop 4 are formed to have the same thickness on the pair of tapes 7, 7.

Further, with respect to the sheet 6 side in the thickness direction, the first stop 4 has the same thickness in the boundary portion 4*j* with the sheet 6 and in the portion corresponding to the stopper 4*c*. Further, the first stop 4 is thinner in the portion on the side of the pair of element rows 8L, 8L with respect to the portion corresponding to the stopper 4*c* than the portion corresponding to the stopper 4*c* of the first stop 4.

The second stop 5 is fixed in a state joining the pair of tapes 7, 7 on the rear side with respect to the pair of element rows 8L, 8L. In other words, the second stop 5 protrudes from both upper and lower surfaces of the pair of tapes 7, 7. The second stop 5 is thicker in the upper-lower direction than the elements 8, and abuts with a rear surface of the slider 2. The second stop 5 is also made of resin and formed by injection molding (insert molding).

The first stop 4 and the sheet 6, which are made of resin, are integral (integrally molded), and are formed by injection molding (insert molding). Since the slide fastener F according to the first embodiment includes the sheet 6 on one surface among both the surfaces of the pair of tapes 7, 7 in the thickness direction, and includes the first exposed surface 7*c* that is a portion of the surface opposite to the sheet 6 on the surface opposite to the sheet 6 among both the surfaces in the thickness direction, when the first stop 4 and the sheet 6 are integrally formed by injection molding, the pair of fastener stringers 3, 3 are sandwiched between an upper mold and a lower mold. A portion corresponding to the sheet 6 of a cavity space in the mold including the upper mold and the lower mold is formed only on the one surface side with respect to the tapes 7. The surface of the tapes 7 opposite to the surface on which the sheet 6 is formed is placed in the lower mold. In addition, in order to prevent flapping of the tapes 7 due to the power of the molten resin at the time of injection molding, the pins for pressing the tapes 7 are arranged in the cavity space. In this way, the mold is formed by the upper mold, the lower mold, and the pins.

Positions of the pins for pressing the tape 7 are only in a portion corresponding to the first stop 4. In order to prevent the flapping at the time of molding, it is preferable to perform injection molding while pressing, with the pins, both the portion corresponding to the first stop 4 and the portion corresponding to the sheet 6. On the other hand, in order to reduce the formation range of the recess 11 as much as possible, the range in which the tapes 7 are pressed by the pins needs to be as small as possible.

Therefore, in the slide fastener F according to the first embodiment of the present invention, the recesses 11 are provided not on the sheet 6 but on the boundary portion 4*j* with the sheet 6 of the first stop 4. That is, injection molding is performed with the pins disposed not on the portion corresponding to the sheet 6, but on the portion corresponding to the boundary portion 4*j* with the sheet 6 of the first stop 4. As described above, since the surface of the tapes 7 opposite to the surface on which the sheet 6 is formed is placed in the lower mold, the molten resin tends to flow to the surface of the tapes 7 on which the sheet 6 is formed. Therefore, by arranging the pins at positions on the sheet 6 side as much as possible, that is, in a portion corresponding to the boundary portion 4*j* as much as possible, although not a portion corresponding to the sheet 6, it is possible to prevent the flapping of the tape 7 during injection molding as much as possible.

Although the slide fastener F according to the first embodiment of the present invention includes the recesses 11 on the first stop 4, since the entire area of the surface of the sheet 6 is a flat portion (the recesses 11 are absent over the entire area of the surface), the formation range of the recesses 11 is smaller than that of a case in which the recesses 11 are present somewhere on the surface of the sheet 6, for example. Further, since the slide fastener F according to the first embodiment includes the second exposed surface 7*d* that is a portion corresponding to the recess region 4*j* in the surface opposite to the sheet 6 among both the surfaces of the pair of tapes 7, 7 in the thickness direction, the formation range of the recesses 11 is smaller than that of a case where the recesses 11 are present in the portion corresponding to the recess region 4*j*, for example.

In the slide fastener F according to the first embodiment, since the first stop 4 includes the recesses 11 on each of the right part of the left side portion 4*d* and the left part of the right side portion 4*e*, as compared to a case where the stop includes the recesses on each of the left part of the left side portion 4*d* and the right part of the right side portion 4*e*, for example, the pair of tapes 7, 7 can be prevented from flapping as much as possible at the time of injection molding, and the appearance of the slide fastener F can be improved. Further, In the slide fastener F according to the first embodiment, since the first stop 4 includes the plurality of recesses 11 at an interval in the left-right interval on each of the left side portion 4*d* and the right side portion 4*e*, as compared to a case where the stop includes one 11 recess on each of the left side portion 4*d* and the right side portion 4*e*, for example, the pair of tapes 7, 7 can be prevented from flapping as much as possible at the time of injection molding, and the appearance of the slide fastener F can be improved.

In the slide fastener F according to the first embodiment, the facing side edges of the pair of tapes 7, 7 are in contact with each other in a portion opposite to the pair of element rows 8L, 8L with respect to the first stop 4 and in a portion opposite to the pair of element rows 8L, 8L with respect to the second stop 5, which improves the sealing property.

As shown in FIGS. 6 to 9, the slide fastener F according to a second embodiment of the present invention is different from the slide fastener F of the first embodiment in that the second sheet 5 includes the recesses 11, the sheet 6 is formed on one surface among both the surfaces in the thickness direction of the pair of tapes 7, 7 in a state adjacent to the second stop 5, and the sheet 6 and the second stop 5 are integral.

The second stop 5 is a quadrangle including a front edge 5*a*, a rear edge 5*b*, a left edge 5*c*, and a right edge 5*d* as viewed from the thickness direction of the tapes 7. The second stop 5 has a left-right symmetrical shape. The front edge 5*a* and the rear edge 5*b* of the second stop 5 are parallel to each other, and the rear edge 5*b* is shortened with respect to the front edge 5*a*.

The second stop 5 extends in a state in which a portion on one surface side (a portion on the sheet 6 side) among both surfaces in the thickness direction is farther from the pair of element rows 8L, 8L than a portion on the opposite side (a portion opposite to the sheet 6). This extension portion is a boundary portion 5*j* with the sheet 6 of the second stop 5. The recesses 11 are formed in the boundary portion 5*j*. Further, in the boundary portion 5*j*, the recesses 11 are formed in a left side portion 5*e* and a right side portion 5*f* of the second stop 5. The second stop 5 is flush (has the same thickness) over an entire area of the surface on the sheet 6 side including the boundary portion 5*j*. A region whose range in the left-right direction is defined by a leftmost recess 11 and a rightmost recess 11 is defined as a recess region 5*k* of the surface of the second stop 5. The sheet 6 joins the pair of tapes 7, 7 in a state adjacent to the recess region 5*k*.

The sheet 6 is formed adjacent to the boundary portion 5*j*. Further, the sheet 6 does not include portions respectively projecting to the left and right sides of the second stop 5. Therefore, the sheet 6 includes only the sheet main body portion 6*a* adjacent to the boundary portion 5*j*. The entire area of the surface of the sheet 6 is a flat portion.

The pair of tapes 7, 7 include the first exposed surface 7*c* that is a portion of the surface opposite to the sheet 6 (a portion corresponding to the sheet 6) among both the surfaces in the thickness direction thereof in the surface opposite to the sheet 6. The pair of tapes 7, 7 include the second exposed surface 7*d* that is a portion corresponding to the boundary portion 5*j* in the surface opposite to the sheet among both the surfaces in the thickness direction thereof.

Although the slide fastener F according to the second embodiment of the present invention includes the recesses 11 on the second stop 5 similarly as the slide fastener F according to the first embodiment, since the entire area of the surface of the sheet 6 is a flat portion (the recesses 11 are absent over the entire area of the surface), the formation range of the recesses 11 is smaller than that of a case in which the recesses 11 are present somewhere on the surface of the sheet 6.

The present invention is not limited to the above-described embodiment, and modifications can be made without departing from the scope thereof.

For example, the recesses 11 are provided only in the first stop 4 without being provided in the second stop 5 in the first embodiment, and are provided in the second stop 5 and may or may not be provided in the first stop 4 in the second embodiment, but are not limited thereto and may be provided on both the first stop 4 and second stop 5 in the present invention.

Regarding the stops, in the first stop 4 of the first embodiment and the second stop 5 of the second embodiment, the part on the sheet 6 side extends in a direction farther from the pair of element rows 8L, 8L in the front-rear direction than the portion opposite to the sheet 6, and the portion on the sheet 6 side and the portion opposite to the sheet 6 are vertically asymmetric, but may be vertically symmetrical without being limited thereto.

The stop includes two recesses 11 provided on each of the left side portions 4*d*, 5*e* and the right side portions 4*e*, 5*f* in the first stop 4 according to the first embodiment and the second stop 5 according to the second embodiment, but may be provided with one or three or more on each without being limited thereto.

The stop includes the same number of recesses 11 provided on each of the left side portions 4*d*, 5*e* and the right side portions 4*e*, 5*f* in the first stop 4 according to the first embodiment and the second stop 5 according to the second embodiment, but may be provided with different numbers without being limited thereto.

REFERENCE SIGNS LIST

F Slide fastener
1 Fastener chain
2 Slider
2*a* Slider body
2*b* Blade plate
2*c* Blade plate
2*d* Connection column
2*e* Pull tab attachment portion
3 Fastener stringer
4 First stop
4*a* Housing
4*b* Raised wall
4*c* Stopper
4*d* Left side portion
4*e* Right side portion
4*h* Column housing hole
4*i* Inlet
4*j* Boundary portion
4*k* Recess region
5 Second stop
5*a* Front edge
5*b* Rear edge
5*c* Left edge
5*d* Right edge
5*e* Left side portion
5*f* Right side portion
5*j* Boundary portion
5*k* Recess region
6 Sheet
6*a* Sheet main body portion
6*b* Projecting portion
7 Tape
7*a* Tape main body
7*b* Coating layer
7*c* First exposed surface
7*d* Second exposed surface
8L Element row
8 Element
8*a* Body
8*b* Neck
8*c* Head
8*d* Shoulder
8*e* Fin
11 Recess

The invention claimed is:

1. A slide fastener comprising:

a pair of fastener stringers including a pair of tapes which extend in a front-rear direction and are arranged adjacent to each other in a left-right direction and a pair of element rows which are fixed along facing side edges of the pair of tapes;

a slider configured to move along the pair of element rows;

a resin stop configured to stop a movement of the slider and joining the pair of tapes at a front or rear side of the pair of element rows; and a resin sheet that joins the pair of the tapes on one surface among both surfaces of the pair of the tapes in a thickness direction of the pair of the tapes, and that extends from the stop on a side opposite to the pair of element rows and is integral with the stop, wherein the pair of tapes include a first exposed surface on which a whole portion of the tapes corresponding to the sheet is exposed in a surface opposite to the sheet among both the surfaces of the pair of tapes in the thickness direction, wherein the stop includes recesses in a left side portion and a right side portion thereof that respectively correspond to the pair of the tapes, and includes a recess region in a surface of the stop that is a region whose range in the left-right direction is defined by leftmost and rightmost ones of the recesses, wherein the recesses are disposed at a boundary portion between the stop and the sheet, so that the recess region is defined at the boundary portion, and wherein a surface of the sheet includes a flat portion that is a region extending from the recess region toward the side opposite to the pair of element rows.

2. The slide fastener according to claim 1, wherein the pair of tapes include a second exposed surface that is a portion corresponding to the recess region in the surface opposite to the sheet among both the surfaces of the pair of tapes in the thickness direction.

3. The slide fastener according to claim 1, wherein the sheet includes projecting portions respectively projecting toward left and right sides with respect to the stop and a sheet main body portion positioned between the projecting portions on the left and right sides, and wherein a surface of the sheet main body portion is a flat portion.

4. The slide fastener according to claim 1, wherein an entire area of the surface of the sheet is a flat portion.

5. The slide fastener according to claim 1, wherein the pair of tapes are in contact with each other in the left-right direction at portions of the facing side edges corresponding to the first exposed surface and a second exposed surface, and wherein the stop includes the recess on each of a right part of the left side portion and a left part of the right side portion.

6. The slide fastener according to claim 5, wherein the stop includes a plurality of recesses at an interval in the left-right direction on each of the left side portion and the right side portion.

7. The slide fastener according to claim 1, wherein the slider includes a pair of blade plates facing each other in a state of sandwiching the pair of element rows in a thickness direction of the slider, and a connection column that connects the pair of blade plates and that is configured to move between the pair of element rows, wherein the stop includes a housing configured to house the connection column, and a stopper that protrudes from a surface opposite to one surface of the stop in the thickness direction where the housing is provided and that is configured to abut with one of the blade plates, and wherein the recess is arranged on a side opposite to the pair of element rows with respect to the stopper.

* * * * *